United States Patent [19]

Sieg

[11] 4,017,920

[45] Apr. 19, 1977

[54] BED DESK

[75] Inventor: Robert C. Sieg, Shanghai, Va.

[73] Assignee: The Raymond Lee Organization, Inc., New York, N.Y. ; a part interest

[22] Filed: July 26, 1976

[21] Appl. No.: 708,325

[52] U.S. Cl. ..... 5/317 R; 5/92; 248/445

[51] Int. Cl.[2] ..... A47C 21/00; A61G 7/02

[58] Field of Search ..... 5/92, 317 R, 327 R, 5/327 B; 248/441, 445; 108/28, 34, 49; 272/144, 900; 269/328

[56] References Cited

UNITED STATES PATENTS

| | | | |
|---|---|---|---|
| 2,546,283 | 3/1951 | Webster | 248/441 A |
| 2,828,577 | 4/1958 | Anderson | 248/445 |
| 3,129,032 | 4/1964 | Meyer et al. | 297/191 X |
| 3,266,061 | 8/1966 | Fuechsel | 5/86 X |
| 3,497,882 | 3/1970 | Weeks | 248/445 X |

*Primary Examiner*—Paul R. Gilliam
*Assistant Examiner*—Andrew M. Calvert
*Attorney, Agent, or Firm*—Howard I. Podell

[57] ABSTRACT

A desk unit mountable on a horizontal bed above an invalid reclining on the bed which enables the invalid to operate a typewriter fixed along a vertical inclined plane of the unit. Alternately, the desk may be employed for reading of material lying on a window over the invalid or for writing purposes. The unit is formed of an open frame fitted with fixed legs, with a panel hinged to the foot end of the frame, and adjustably fastened to vertical risers at the head end of the frame. The panel is fitted with a vertical shelf extending upwards away from a panel opening, with a base, to which a typewriter may be mounted, attachable to the panel shelf. A transparent window in the panel permits the user to read a book lying on the window.

3 Claims, 3 Drawing Figures

BED DESK

SUMMARY OF THE INVENTION

My invention is a desk unit mountable on a horizontal bed above an invalid reclining on the bed which enables the invalid to operate a typewriter fixed along a vertical inclined plane of the unit. Alternately, the desk may be employed for reading of material lying on a window over the invalid or for writing purposes. The unit is formed of an open frame fitted with fixed legs, with a panel hinged to the foot end of the frame, and adjustably fastened to vertical risers at the head end of the frame. The panel is fitted with a vertical shelf extending upwards away from a panel opening, with a base, to which a typewriter may be mounted, attachable to the panel shelf. A transparent window in the panel permits the user to read a book lying on the window. The unit may be fabricated so as to be collapsible for storage or transportation purposes.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
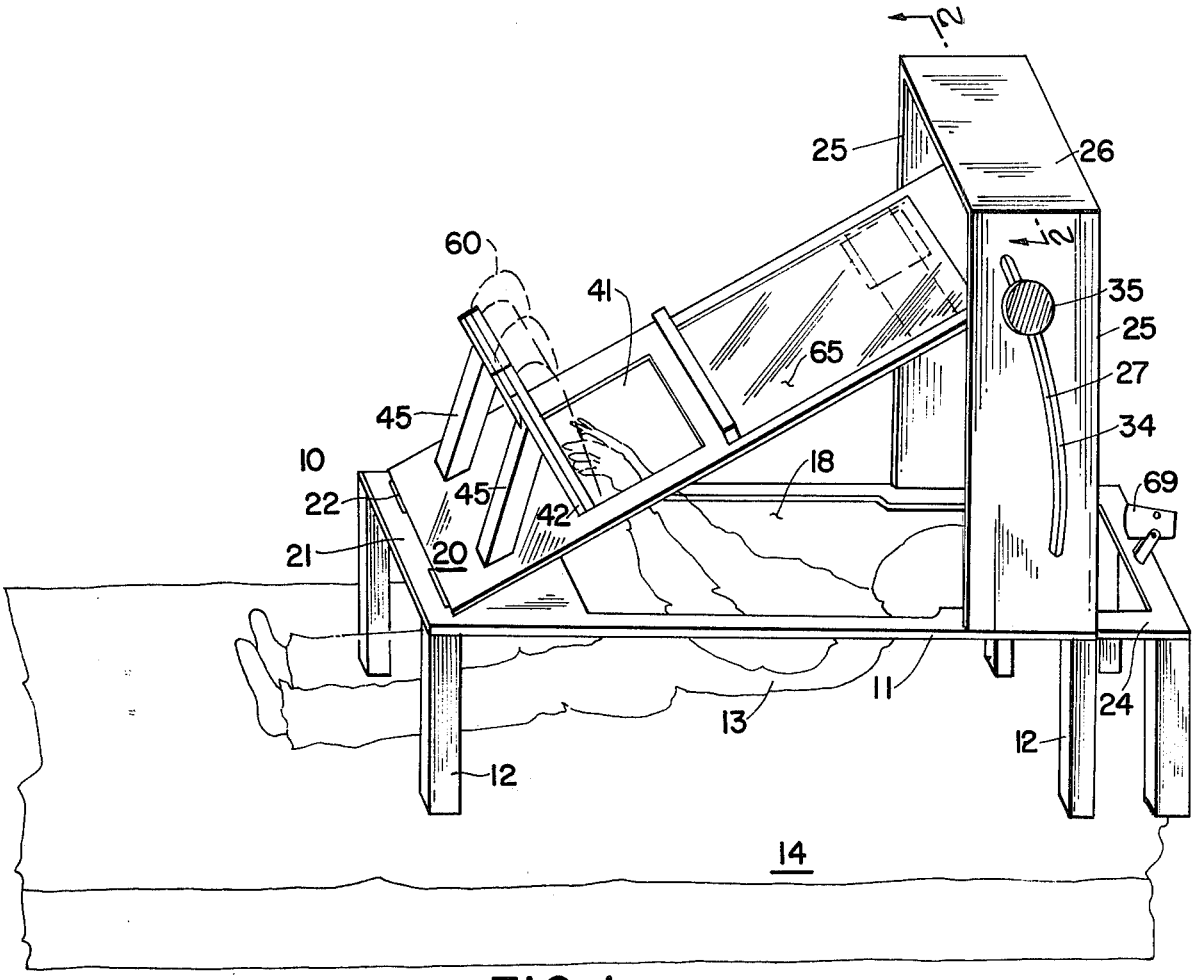
FIG. 1 is a perspective view of the invention in use.
Figure 2:
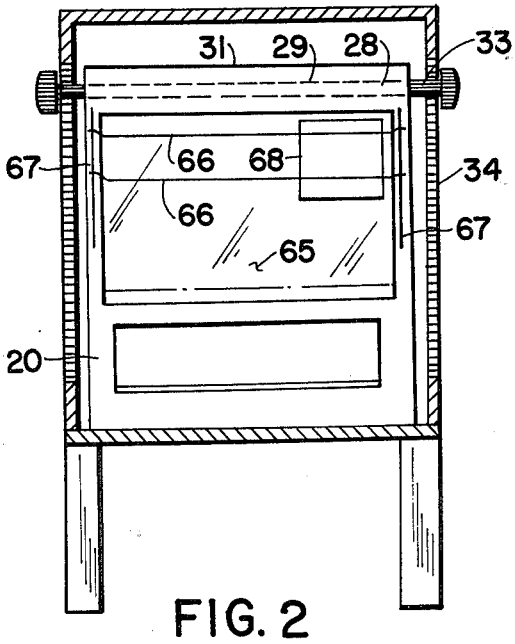
FIG. 2 is a sectional view of the invention, taken along line 2—2 of FIG. 1.
Figure 3:
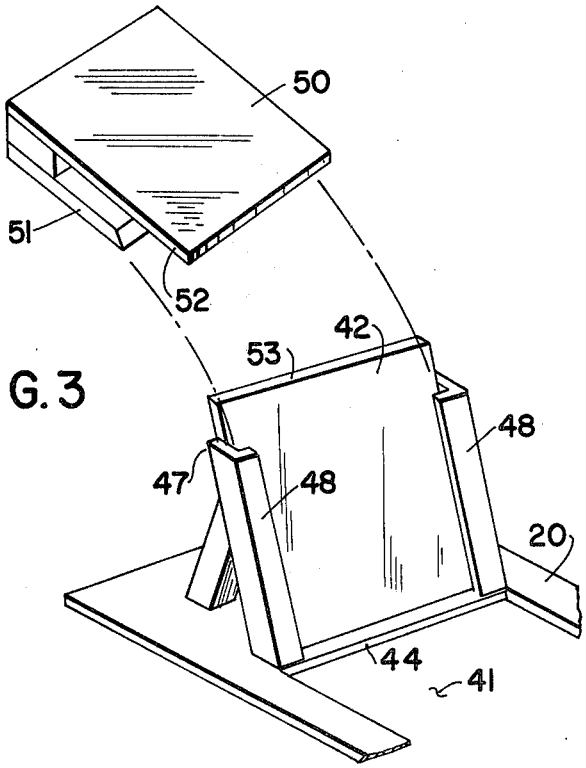
FIG. 3 is an exploded perspective view of the typewriter base and shelf.

Turning now descriptively to the drawings, in which similar reference characters denote similar elements throughout the several views, FIGS. 1–3 illustrate the bed desk assembly 10. An open frame 11 is supported on six fixed legs 12 of a length to extend frame 11 above an invalid 13 lying on a mattress 14, on which legs 12 rest with legs 12 spaced to extend about the sides of the invalid 13. Frame 11 is formed with a central rectangular-shaped opening 18 extending across most of its length and width.

A panel 20 is fitted to the foot end 21 of frame 11 by hinges 22, and supported at an inclined plane adjustably at the head end 24 of frame 11 by a pair of vertical supports 25 mounted on frame 11 and extending vertically upwards from frame 11. Supports 25 are joined together at their upper ends by a horizontal brace 26. An arcuate through slot 27 is formed in each support 25 through each of which slots 27 a shaft 28 extends with shaft 28 passing through a transverse hole 29 in the head section 31 of panel 20. Shaft 28 is rotatably snugly mounted in hole 29 to provide frictional torque resistance. Shaft 28 is formed externally with gear teeth 33 which mate with rack teeth 34 embossed in a wall of arcuate slot 27. A knob 35 is externally fixed to each extension of shaft 28 beyond support 25 to enable the user to adjust the angle of incline of panel 20 by rotation of one or both knobs 35.

A rectangular-shaped through opening 41 is formed in panel 20 adjacent a fixed shelf 42 and extending perpendicular to the plane of panel 20 upwards from the foot end 44 of opening 41. Shelf 42 is supported by inclined fixed braces 45 fixed to its rear face 47 and to panel 20. A pair of L-shaped flanges 48 are mounted to each side of shelf 42 to engage the side edges of an attachable plate 50 that may be hung on shelf 42 in flanges 48, with plate 50 fitted with an L-shaped flange 51 on its rear face 52 so as to engage the top edge 53 and rear face 47 of shelf 42 in the installed position. A typewriter 60 may be fixed to a plate 50 so as to extend parallel to the plane of shelf 42 with the typewriter keys and platen accessible to the invalid 13 through opening 41.

Plate 50 on typewriter 60 may be fitted with a shaped metal clip that curves about the roller of the typewriter to retain a sheet of paper on the typewriter roller from falling over the typewriter keys in the installed position of the typewriter 60.

Alternately additional plates 50 may be fitted with clips for holding of notepaper to be written upon.

A rectangular-shaped transparent window 65 is fitted near the head end 31 of panel 20 and fitted with transverse wires 66 slidably mounted to longitudinal wires 67 along the periphery of window 65 to retain reading matter 68 on the top face of window 65.

A reading light 69 is adjustably mounted on frame 11 to cast light upward onto the undersurface of window 65 and through typewriter opening 41.

Frame 11 is preferably of a minimum width that permits the invalid to extend an arm about the external side of the frame.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A desk assembly adaptable for mounting on a bed above a reclining invalid comprising an open frame fitted with legs, a panel hinged to a foot end of the panel and supported at an adjustable height above the opposed head end of the frame by support members extending above the head end of the frame, said panel fitted with an opening, and a shelf extending alongside said opening in an angular plane to the plane of the panel, said shelf fitted with detachable means to fasten a typewriter to said shelf.

2. The combination as recited in claim 1 in which a transparent window mounted in the panel.

3. The combination as recited in claim 2 together with wire means to attach reading matter to the window.

* * * * *